US006118263A

United States Patent [19]

O'Neill et al.

[11] Patent Number: 6,118,263

[45] Date of Patent: Sep. 12, 2000

[54] CURRENT GENERATOR CIRCUITRY WITH ZERO-CURRENT SHUTDOWN STATE

[75] Inventors: Dennis P. O'Neill, Monte Sereno; Richard T. Owen, Fremont, both of Calif.

[73] Assignee: Linear Technology Corporation, Milpitas, Calif.

[21] Appl. No.: 09/239,048

[22] Filed: Jan. 27, 1999

[51] Int. Cl.[7] ..... G05F 3/16

[52] U.S. Cl. ..... 323/315; 323/901

[58] Field of Search ..... 323/312, 315, 323/901

[56] References Cited

U.S. PATENT DOCUMENTS

| | | | |
|---|---|---|---|
| 3,617,859 | 11/1971 | Dobkin et al. | 323/313 |
| 4,789,819 | 12/1988 | Nelson | 323/314 |
| 5,274,323 | 12/1993 | Dobkin et al. | 323/280 |
| 5,694,031 | 12/1997 | Stanojevic | 323/315 |
| 5,744,999 | 4/1998 | Kim et al. | 323/315 |
| 5,902,227 | 11/1999 | Kim et al. | 323/315 |
| 6,016,050 | 1/2000 | Brokaw | 323/315 |

*Primary Examiner*—Jeffrey Sterrett

*Attorney, Agent, or Firm*—Fish & Neave; Michael E. Shanahan

[57] ABSTRACT

A bias generator circuit having a zero-current shutdown state is provided. When on, the bias generator circuit provides substantially constant bias currents (sourcing and/or sinking) and may be selectively turned on and off in response to first and second control signals. When the bias generator is off, it is in a zero-current shutdown state such that substantially no quiescent current is used.

29 Claims, 4 Drawing Sheets

CURRENT GENERATOR CIRCUITRY WITH ZERO-CURRENT SHUTDOWN STATE

BACKGROUND OF THE INVENTION

This invention relates to current generator circuitry. More particularly, this invention relates to current generator circuitry that can be selectively placed in a zero-current shutdown state.

The purpose of current generator circuitry or "bias" circuitry in an electronic circuit is twofold. It supplies the power necessary for portions of a circuit to operate and establishes the dynamic range in which the powered devices function.

Bias circuitry can be implemented in numerous forms. For example, a bias circuit suitable for use with a discrete NPN transistor may supply a positive voltage ($V_{cc}$) to the NPN transistor's collector through a collector resistor ($R_c$). The emitter of this NPN transistor may be connected to ground. In such an arrangement, the maximum amount of bias current ($I_c$) that can be supplied to the NPN transistor can be determined by dividing the supplied voltage by the value of the collector resistor (i.e., $I_c=V_{cc}/R_c$) . The amount of bias current actually drawn by a transistor, however, is usually dependent upon the magnitude of a drive signal supplied to its base. When the base drive signal is at its minimum, then so is the bias current, and vice versa. Thus, the NPN transistor's dynamic operating range is determined by the minimum and maximum amounts of bias current that can be drawn through the transistor's collector from $V_{cc}$ (again, which is dependent on the of drive signal provided to the transistor's base). For example, when an input signal less than approximately 600 mV is applied to the NPN transistor's base, substantially no bias current is drawn into the transistor's collector, at which point the transistor is in cutoff (the minimum point of the dynamic range). On the other hand, when a large enough signal is applied to the transistor's base, the maximum amount of bias current ($I_c$) is drawn into the transistor's collector, at which point the transistor is in saturation (the maximum point of the dynamic range).

Fluctuations in the amount of bias current can significantly alter this dynamic operating range and adversely affect circuit operation. For example, circuit designers often select the operating point (Q-point) of a transistor using a load-line analysis technique that requires a constant DC bias current as an initial condition. Any significant change in that DC bias current alters the slope of the load-line and shifts the position of the Q-point. Such changes can cause transistors in a given circuit to go into cutoff or saturation at undesirable times and thus degrade circuit performance. It is therefore important that bias circuitry has the ability to provide a substantially constant amount of current, even if supply voltages vary.

Another important characteristic of bias circuitry is its quiescent current (i.e., the minimum operating current required by the bias circuitry when substantially no bias current is provided). It is generally desirable to reduce the quiescent current to the lowest possible value. One reason for this is the increasing demand for battery powered devices that have long "active" periods. Because the active periods of such devices are directly dependent on battery power, it is desirable to make this battery power last as long as possible. One way to do this is to reduce the amount of quiescent current used by bias circuitry in a given device.

An example of a prior art circuit is shown in Dobkin et al. U.S. Pat. No. 5,274,323 (the '323 patent). FIG. 1 is a schematic representation of the relevant portions of the current generator circuitry shown in the '323 patent (designated herein as current generator circuit 100). Current generator circuit 100 generally comprises a start-up section 101, a current supply (sourcing circuit) 102, and a bias section 103.

The purpose of start-up section 101 is to turn ON PNP transistors 120A–120E when a voltage differential first appears across the DRIVE and GND terminals. The start-up section includes transistors 110, 111, 112. Transistor 110 is a JFET produced by epitaxial growth and serves the purpose of providing current to diodeconnected transistor 111 when a voltage differential appears across the DRIVE and GND terminals. Transistor 111 is fabricated to have a high turn-on voltage (VBE approximately 850 mV at 25° C.). With current flowing through transistor 110, transistors 111 and 112 turn On, sending current through resistors 121 and 122 and simultaneously drawing current from the common base node of transistors 120A–120E. This causes transistors 120A–120E, all of which have their base-emitter circuits connected in parallel, to turn on. The turning On of transistor 120E causes additional current flow through resistors 121 and 122. This additional current increases the voltage at the emitter of transistor 112 (i.e., across resistors 121 and 122) so as to eventually reverse bias the base-emitter junction of 112 and therefore shutoff start-up circuit 101 from the rest of the circuit after transistors 120A–120E have been turned on. Once transistors 120A–120E are operating, the components in start-up circuit 101 are of no consequence.

Moving further to the right of FIG. 1, NPN transistors 130, 131, and 132 form bias section 102. These transistors bias PNP transistors 120A–120E to provide a substantially constant current from all their collectors even with changing DRIVE voltage. This substantially constant current is also used to generate a substantially constant reference voltage across resistors 121 and 122. Bias section 102 can operate down to approximately one volt.

Transistors 130 and 131, which are connected in a current mirror configuration, have unequal emitter areas in a ratio of 10:1, causing a voltage of approximately 60 mV to appear across resistor 134 when transistors 130 and 131 conduct equal currents. The collector of NPN transistor 132 is connected back to the bases of transistors 120A–120E to provide a feedback loop. This feedback loop ensures that sourcing circuit 102 provides a substantially constant current even with changing voltage at the DRIVE terminal. Capacitor 133 is provided as frequency compensation for the feedback loop. Current generator circuit 100 turns off when the voltage supplied to bias section 102 drops below approximately one volt.

As can be seen from the above discussion, the current generator circuitry of the '323 patent will always be on and thus constantly draw substantial amounts of quiescent current whenever a sufficient DRIVE voltage is present to provide bias section 103 with approximately one volt of potential.

It would therefore be desirable to provide a current generator circuit that can be selectively turned off and placed in a substantially zero-current shutdown state independent of the DRIVE voltage so that quiescent current consumption is reduced.

SUMMARY OF THE INVENTION

It is therefore an object of the present invention to provide current generator circuitry that can be selectively turned off and placed in a zero-current shutdown state.

This and other objects of the invention are accomplished by providing current generator circuitry that includes a shutdown circuit that can selectively turn off the current generator circuit and place it in a substantially zero-current shutdown state. When in the zero-current shutdown state, the current generator's quiescent current is approximately equal to the leakage currents of semiconductors within the circuit (typically less than 100 nA).

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PREFERRED EMBODIMENTS

Figure 2:
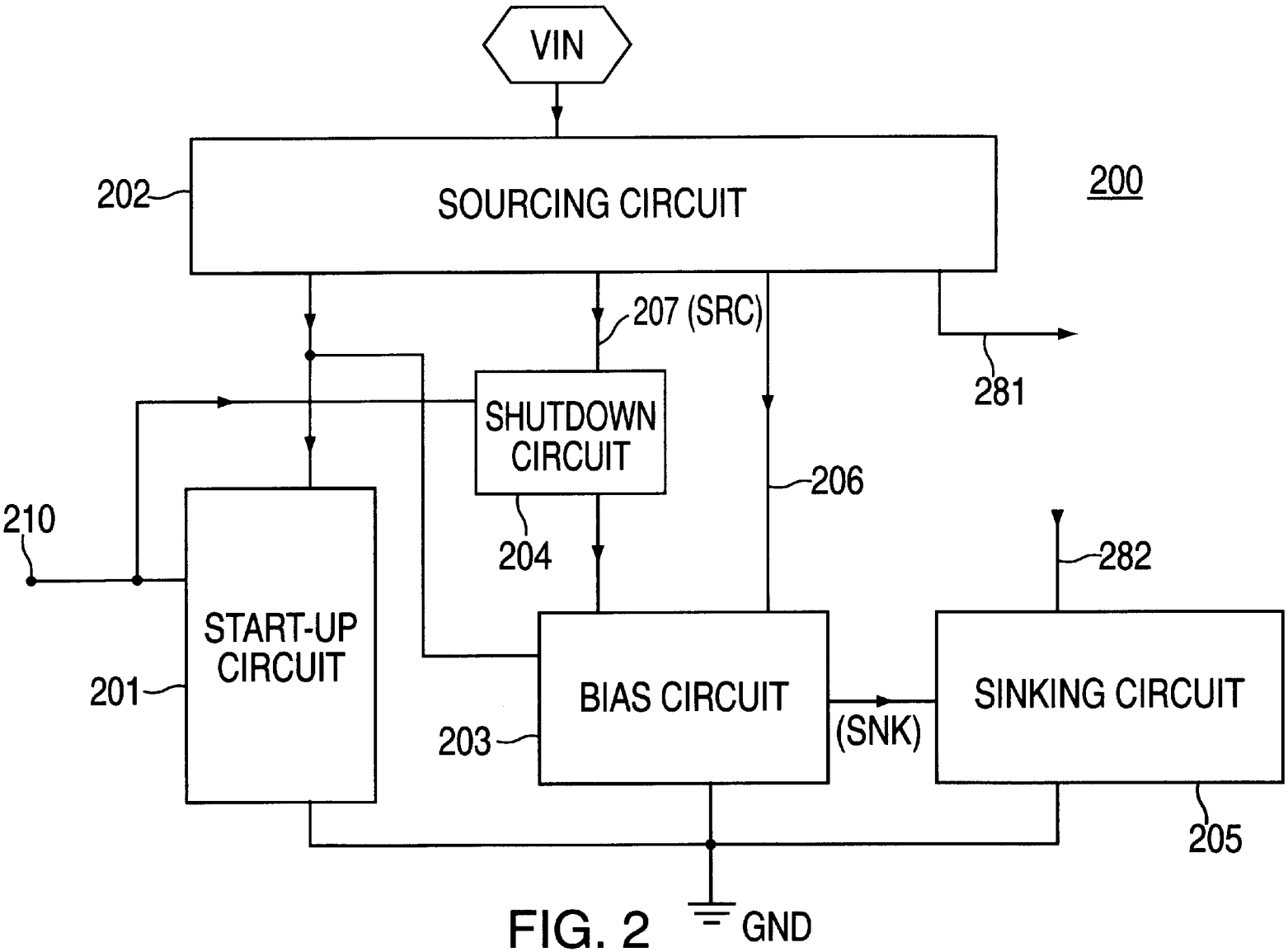
FIG. 2 is a block diagram of a current generator circuit constructed in accordance with principles of the present invention.

FIG. 2 is a block diagram of a current generator circuit 200 that has a substantially zero-current shutdown state and can be used to generate bias currents in larger circuits. Current generator 200 preferably comprises five sections: a start-up circuit 201, a sourcing circuit 202, a bias circuit 203, a shutdown circuit 204, and a sinking circuit 205 (although sinking circuit 205 is optional).

Figure 1:
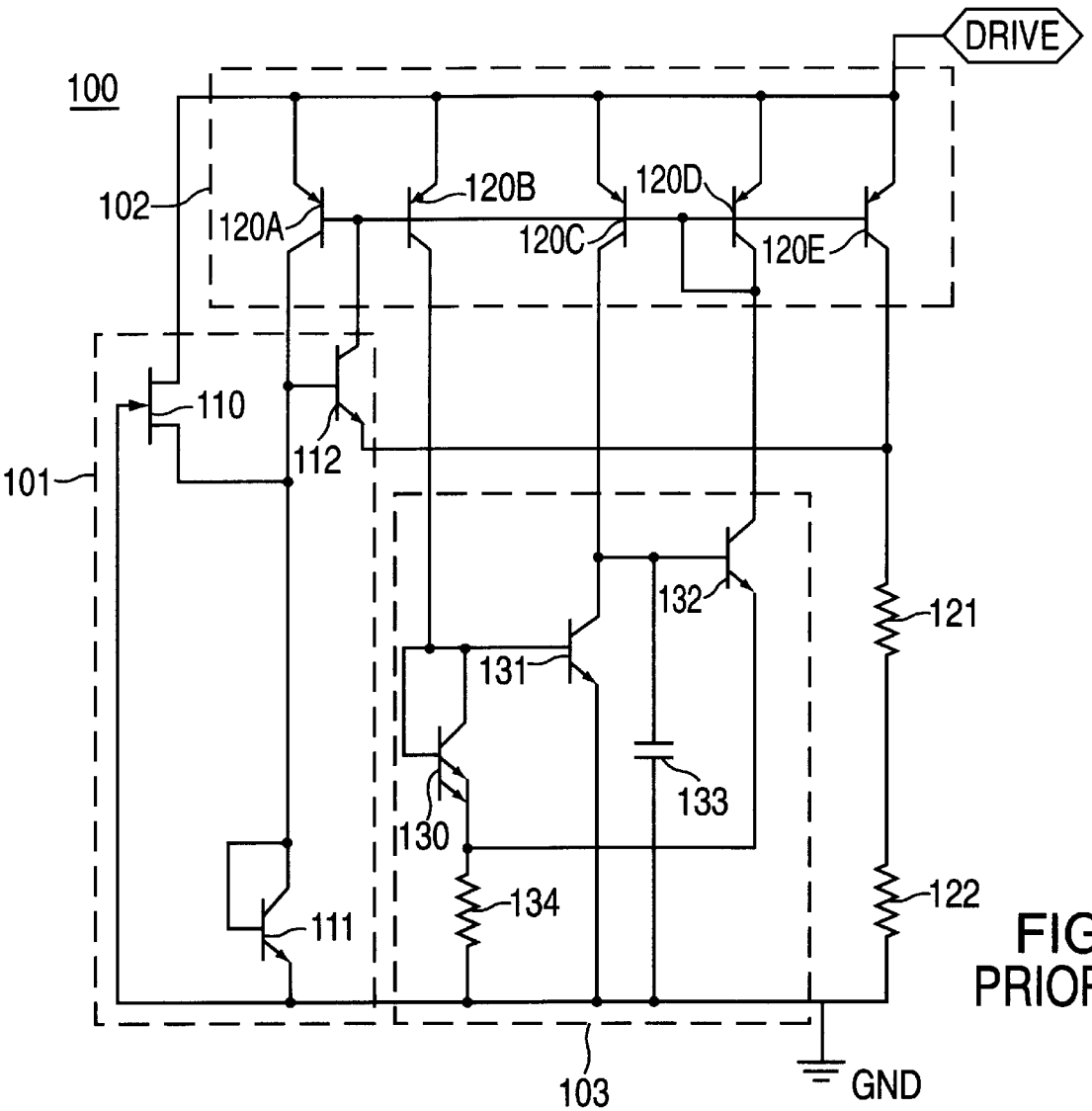
FIG. 1 PRIOR ART
FIG. 1 is a schematic diagram of a prior art current generator circuit.

In general, the current generator of FIG. 2 operates as follows. Assume that a sufficient $V_{IN}$ voltage is applied to sourcing circuit 202, and an ON control signal is applied to input node 210 (in the preferred embodiment, as further discussed below, the ON signal is a voltage greater than or equal to about one $V_{BE}$). The start-up signal causes start-up circuit 201 to turn on sourcing circuit 202, thus enabling a small current to flow into bias circuit 203 through paths 206 and 207. This causes bias circuit 203 to turn on and generate two control signals: an SRC signal and an SNK signal. The SRC signal is a feedback signal that is coupled to sourcing circuit 202 for controlling the amount of current supplied by sourcing circuit 202. Sourcing circuit 202 may supply current to additional circuitry not shown in FIG. 1 (represented generally by line 281). The SNK signal is coupled to sinking circuit 205 and controls the amount of current drawn from other circuitry (not shown) connected to it via line 282.

When bias circuit 203 first turns on, unequal amounts of current flow through some of its internal components (not shown) causing the SRC feedback signal to turn sourcing circuit 202 on further. As a result, more current is provided to bias circuit 203. As this current increases, current flow through the internal components begins to equalize until a stable operating condition is reached. Generally speaking, this is the point at which the current provided to bias circuit 203 through paths 206 and 207 matches the amount of current the SRC signal is causing components within sourcing circuit 202 to supply. During stable operation, a substantially constant current proportional to absolute temperature (PTAT) is provided by sourcing circuit 202. This current remains substantially constant even with a fluctuating voltage at the $V_{IN}$ terminal.

Sinking circuit 205 operates similarly to sourcing circuit 202, turning on marginally in response to the SNK signal when bias circuit 203 is first activated, and, turning on further as the voltage path 207 increases (i.e., the SNK signal). Once the stable operating point is reached, sinking circuit 205 provides a path from which a substantially constant current may be removed from other circuitry (not shown) to which it is connected. Both sourcing circuit 202 and sinking circuit 205 may be turned on simultaneously by bias circuit 203. Thus, when bias circuit 203 reaches its stable operating condition, substantially constant PTAT sinking and sourcing currents are produced by current generator 200. These currents remain constant even with a changing $V_{IN}$ voltage. Moreover, during stable operation, start-up circuit 201 is shut off from the rest of current generator 200 and plays no part in controlling sourcing circuit 202.

Shutdown circuit 204 is coupled between sourcing circuit 202 and bias circuit 203, and includes an input that is coupled to input node 210. When it is desired to turn current generator 200 off, an OFF signal is applied to node 210. In the preferred embodiment, the OFF signal has a voltage that is less than about one $V_{BE}$ (e.g., about 500 mV). The OFF signal causes shutdown circuit 204 to interrupt the flow of current from sourcing circuit 202 to a portion of bias circuit 203. This turns off the SRC signal, which forces sourcing circuit 202 to also turn off. As a result, the rest of current generator 200 (i.e., bias circuit 203 and sinking circuit 205) also turns off. Once current generator 200 is off, it will not turn on again until another ON signal is applied to node 210.

Figure 4:
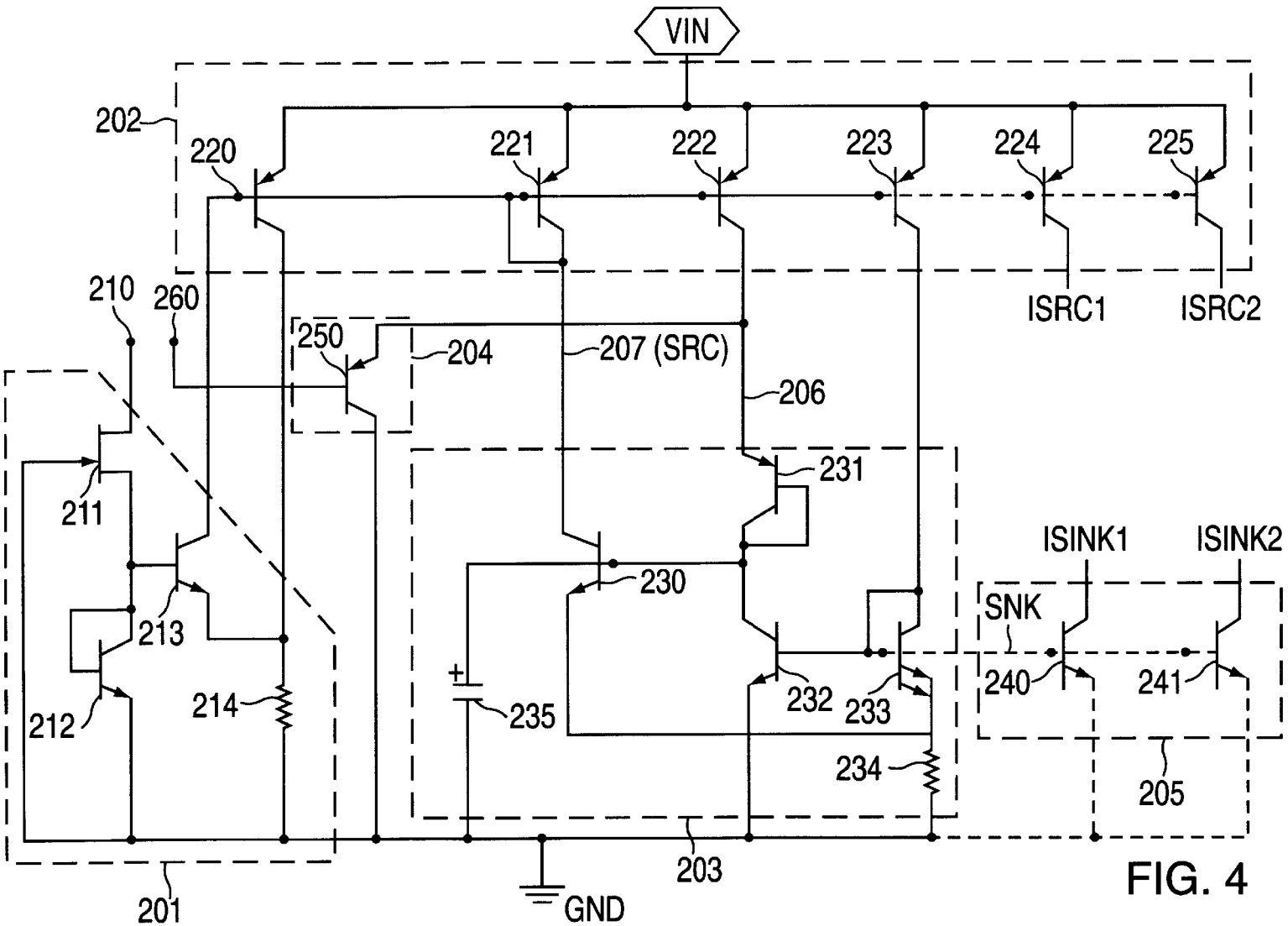
FIG 4 is a schematic diagram of the current generator circuit shown in FIG. 3 illustrating an embodiment with separate control nodes.

As further discussed below, shutdown circuit 204 may of course be coupled elsewhere in the circuit in order to turn off circuit 200. Furthermore, rather than share input node 210 as described above, shutdown circuit 204 may have its input coupled to a separate node shown in FIG. 4 that is not associated with input circuit 210. In such a case, the ON signal would be coupled to input node 210 to turn current generator 200 on, and the OFF signal would be applied to a separate input node 260 to turn current generator 200 off.

Figure 3:
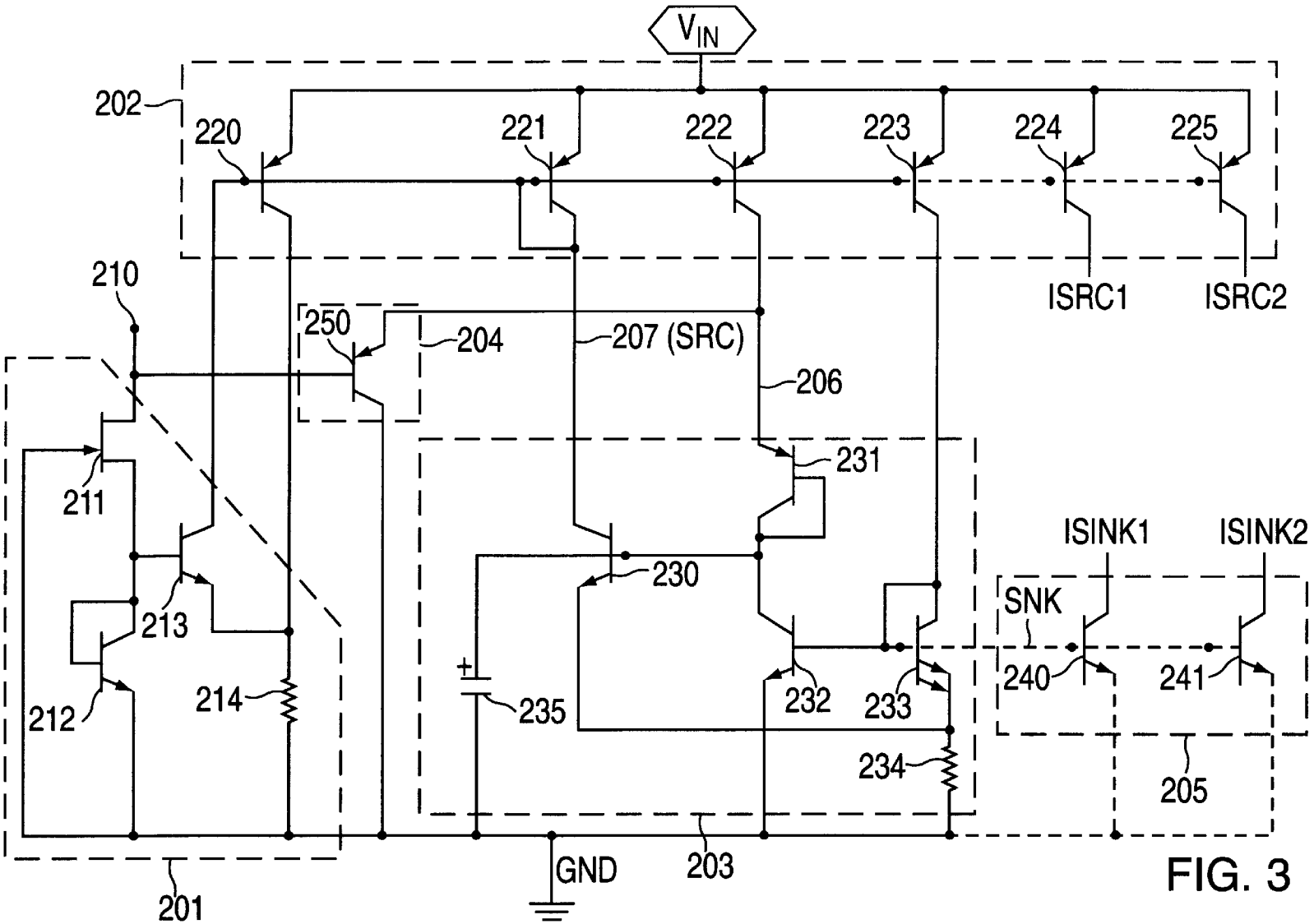
FIG. 3 is a schematic diagram of a current generator circuit shown in FIG. 2.

A schematic diagram of a preferred embodiment of current generator 200 is shown in FIG. 3. Start-up circuit 201 includes a field-effect transistor (FET) 211 and a current mirror formed by NPN transistors 212 and 213, and resistor 214. Assuming that the voltage at $V_{IN}$ is sufficient for the circuitry to operate (in the case of FIG. 3, about 1.5 volts, corresponding to two base-to-emitter plus one transistor saturation voltage drops), current generator 200 is turned on by applying an ON signal to node 210. The ON signal is a signal having a voltage equal to or greater than one $V_{BE}$ (about 650 mv). Upon application of the ON signal, current starts to flow through FET 211. This forward biases NPN transistor 213, which turns on and draws current through resistor 214 from the common base node of PNP transistors 220–225 of sourcing circuit 202. In addition, diode-connected NPN transistor 212 also begins to turn on. Transistor 212 preferably is constructed in a conventional manner to have a $V_{BE}$ voltage approximately 100 mV higher than standard NPN transistor 213 (through area rationing or special processing). Transistor 212 establishes the amount of base drive that may be applied to transistor 213. The turning on of transistor 220 causes transistors 221–225, all of which have their base-emitter circuits connected in parallel with transistor 220, also to turn on. Once on, transistors 222 and 223, which have equal emitter area ratios (1X), then source substantially equal current to bias circuit 203 to thereby turn on the bias circuit. It will be understood that although transistors 220–225 are depicted in FIG. 3 as discrete, they could be combined into one or more multiple-collector PNP transistor(s) having a common base.

Bias circuit 203 is coupled to sourcing circuit 202 and includes NPN transistor 230, diode-connected PNP transistor 231, capacitor 235, and a current mirror formed by NPN transistors 232/233 and resistor 234. Current mirror transistors 232 and 233 preferably have an emitter area ratio of 1:10 (although other emitter area ratios could be used). Thus, when the $V_{BE}$ voltages of transistors 232 and 233 are the same, only one-tenth the current that flows through transistor 233 flows through transistor 232.

When sourcing circuit 202 first turns on, very little current is sourced to bias circuit 203 by transistors 222 and 223. Because of this, very little current flows through resistor 234 and almost no voltage drop occurs across resistor 234. Thus, the base-emitter voltages of transistors 232 and 233 of the current mirror are virtually equal. Accordingly, at first turn on, the current flowing through transistor 232 of the current mirror is restricted to one-tenth of that flowing through transistor 233 of the current mirror.

Because the currents supplied by transistors 222 and 223 are substantially equal (because they have substantially equal area ratios), more current is initially available at the collector of transistor 232 than it can conduct. The surplus current (i.e., the difference between the amount of current supplied by transistor 222 and the amount of current conducted by transistor 232) flows into the base of NPN transistor 230, turning it on and producing the SRC control signal. This signal is coupled back to the bases of transistors 220–225 as a feedback signal. Thus, once transistor 230 turns on, more current is drawn from the bases of transistors 220–225 so that they are turned on harder and supply more current. As the current supplied by transistors 222 and 223 increases, the current flowing through resistor 234 increases. When the voltage across resistor 234 reaches the approximate base-emitter voltage ($V_{BE}$) difference between a 1X and a 10X transistor (in this case about 60 mV at 25° C.), transistors 232 and 233 operate at approximately equal collector currents, causing the surplus current supplied to transistor 230 to drop off.

If the currents from transistors 222 and 223 rise to the point that the voltage across resistor 234 is larger than the VBE difference between transistor 232 (a 1X device) and transistor 234 (a 10X device), transistor 232 will be able to conduct a larger current than that supplied by transistor 222. This will reduce the amount of base current supplied to transistor 230, causing transistor 230 to conduct less current and transistors 220–225 of sourcing circuit 202 to conduct less.

Therefore, in operation, sourcing circuit 202 will initially provide bias circuit 203 with a small amount of operating current. As bias circuit 203 turns on, it causes sourcing circuit 202 to provide more current until the voltage generated across resistor 234 equals the approximate $V_{BE}$ difference between a 1X and a 10X transistor (about 60 mV). This causes the amount of current drawn by transistor 230 to be substantially equal to the amount of current supplied by sourcing circuit 202, thus "locking" current generator 200 in a stable operating state. During stable operation, a substantially constant PTAT current is provided by sourcing circuit 202 even though the $V_{IN}$ voltage may vary. However, as mentioned above, should sourcing circuit 202 overshoot (i.e., provide an amount of current which causes the voltage across resistor 234 to exceed 60 mV), transistor 230 will draw less current until the stable operating condition is reached. The opposite occurs on undershoot. In addition, once transistors 220–225 have fully turned on, the voltage across resistor 214 will have risen to the point of back-biasing transistor 213 to turn it off. Thus, with sourcing circuit 202 fully turned on, start-up circuit 201 including transistor 213 has no effect on the operation of the circuit.

The emitter of transistor 230 may be connected either to the emitter of transistor 233 (as shown), or through an additional resistor to ground (not shown). Capacitor 235 is coupled between the collector of transistor 232 and ground, and provides frequency compensation to bias circuit 203. While in the stable operating state, PNP transistor 220 becomes a current source and generates a proportional to absolute temperature voltage across resistor 214.

Additional current sources can be created in sourcing circuit 202 by adding more PNP transistors to source other currents. The bases of these additional PNP transistors would be connected to the bases of transistors 220 through 223 and their emitters would be connected to $V_{IN}$. An illustrative example of this is shown in FIG. 3 by the dotted-line connection of additional PNP transistors 224 and 225. The collectors of the added transistors serve as the additional current sources ISRC1 and ISRC2. These additional current sources could be used, for example, to bias other circuitry (not shown). Although only two additional transistors 224 and 225 are shown in FIG. 3, additional ones could be added to meet specific needs.

Similarly, sinking circuit 205 can be created by adding NPN transistors to current generator 200. The bases of the additional NPN transistors would be connected to the bases of transistors 232 and 233 and their emitters coupled to ground. (Although in an alternate embodiment, the GND node could be replaced with a negative voltage potential if desired (not shown)). An illustrative example of this is shown in FIG. 3 by the dotted-line connection of NPN transistors 240 and 241. The collectors of the added transistors serve as additional current sinks ISINK1 and ISINK2. These current sinks could be used, for example, to bias other circuitry (not shown). Although only two NPN transistors 240 and 241 are shown in FIG. 3, additional ones could be added to meet specific needs.

As shown in FIG. 3, shutdown circuit 204 includes PNP transistor 250 having a base coupled to input node 210, an emitter coupled to a node defined between the emitter of diode-connected transistor 231 and the collector of transistor 222, and a collector coupled to ground. The purpose of transistor 231 is to provide a level shift so that the emitter of transistor 250 is at approximately two $V_{BE}$ voltages above ground. When the circuit is on and operating to source currents, transistor 250 is reverse biased and has no effect on the operation of current generator 200.

To turn circuit 200 off, an OFF control signal is selectively applied to input node 210. The OFF signal is a signal having a voltage less than one $V_{BE}$. When the OFF signal is applied, the base-emitter junction of transistor 250 becomes forward-biased (due to the two $V_{BE}$ voltages at the emitter of transistor 250) and current is shunted by transistor 250 from the collector of transistor 222 to ground. This effectively grounds the emitter of transistor 231, which causes both that transistor and transistor 230 to turn off. The turning off of transistor 231 stops current from being removed from the bases of transistors 220–225, which turns off sourcing circuit 202 as well as the rest of circuit 200 (i.e., bias circuit 203 and sinking circuit 205). As long as the voltage at input node 210 is held below one $V_{BE}$, current generator 200 will remain off and will not start-up again until the ON signal is applied to node 210.

Thus, an OFF signal at input node 210 places current generator 200 in a substantially zero-current shutdown state in which substantially no current is drawn from the $V_{IN}$ node. When in the substantially zero-current shutdown state, the quiescent current drawn by current generator 200 is effectively reduced to the leakage currents present in sourcing circuit 202 (typically less than 100 nA).

Persons skilled in the art will understand that although shutdown circuit 204 is coupled as shown in FIG. 3, other circuit arrangements could also be used. For example, a shutdown circuit responsive to an OFF signal could be coupled between the base of NPN transistor 230 and ground (GND). Such a shutdown circuit could comprise a PNP transistor having an emitter coupled to the base of transistor 230, a base coupled to node 210 (or to a separate node), and a collector coupled to GND. In this circuit, current generator 200 would be turned off by grounding node 210.

Persons skilled in the art will appreciate that the present invention can be practiced, without departing from its scope, in still other embodiments than the ones expressly described herein. For example, it is well known in the art that transistor conductivity types can be reversed as long as the appropriate biases and power supply connections are also reversed.

The current generator circuit of the present invention is suitable for use in many electronic circuits requiring bias circuitry. One example of a circuit in which current generator 200 may be used is in the low-dropout regulator circuit disclosed in commonly assigned co-pending U.S. patent application Ser. No. 09/239,047, entitled "Error Amplifier Circuits For Low Output Voltage Control Circuits," filed on even date herewith.

Thus it is seen that a current generator circuit has been provided that starts-up and operates from low supply voltages (e.g., 1.5V $V_{IN}$ voltage), which can be selectively turned on and off by application of appropriate control signals and which, when off, is in a substantially zero-current shutdown state in which the quiescent current drawn by the circuit is reduced to substantially leakage current. Persons skilled in the art will appreciate that the present invention can be practiced by other than the described embodiments, which are presented for purposes of illustration and not of limitation, and the present invention is limited only by the claims which follow.

What is claimed is:

1. A current generator circuit adapted to be coupled to an input voltage source, said current generator circuit comprising:

a start-up circuit that provides a start-up signal in response to a first control signal;

a first current supply circuit coupled for supplying one or more currents in response to said start-up signal;

a bias circuit, coupled to said first current supply circuit, that provides a feedback signal for biasing said first current supply circuit so that said currents, when provided, are maintained substantially constant; and a shutdown circuit responsive to a second control signal for placing said current generator circuit in a substantially zero-current shutdown state in which said first current supply circuit stops supplying said currents and the current generator circuit draws a quiescent current substantially equal to leakage currents in said first current supply circuit.

2. The current generator circuit of claim 1, wherein said start-up circuit and said shutdown circuit are coupled to a common control terminal, and said first and second control signals are applied to said common control terminal.

3. The current generator circuit of claim 1, further including:

a first control terminal coupled to said start-up circuit; and a second control terminal coupled to said shutdown circuit, said second control terminal being independent of said first control terminal; wherein said first control signal is applied to said first control terminal, and said second control signal is applied to said second control terminal.

4. The current generator circuit of claim 1, wherein said first current supply circuit supplies source currents.

5. The current generator circuit of claim 4, further comprising a second current supply circuit coupled to said bias circuit, said second current supply circuit supplying a substantially constant sink current.

6. The current generator circuit of claim 1, wherein:

said start-up circuit is coupled to draw current from said input voltage source to turn on said first current supply circuit when said first control signal reaches a first predetermined threshold value; and said shutdown circuit is coupled to remove bias current from said bias circuit to turn off said current supply circuit when said second control signal reaches a second predetermined threshold value.

7. The current generator of claim 6, further comprising a control terminal coupled in common to said start-up circuit and to said shutdown circuit, wherein said first and second control signals are applied to said common control terminal.

8. The current generator of claim 6, wherein said first and second predetermined threshold values are different.

9. The current generator circuit of claim 1, wherein:

said current supply circuit includes a plurality of parallel-connected transistors, each having an emitter connected to a common voltage source, a base connected to a common base node, and a collector for supplying at least a portion of said current, one of said parallel-connected transistors being diode-connected;

said bias circuit includes (1) a current mirror having first and second current mirror transistors and a resistor coupled to an emitter of one of said current mirror transistors, said first current mirror transistor coupled to a collector of a first of said parallel-connected transistors and said second current mirror transistor coupled to a collector of a second of said parallel-connected transistors, (2) a feedback transistor coupled to the collector of said diode-connected transistor for maintaining said supplied currents substantially constant, and (3) a node between said collectors of said first current mirror transistor and said first parallel-connected transistor; and said shutdown circuit includes a shutdown transistor having a collector-emitter circuit coupled between said node and a ground, such that said shutdown transistor turns off said feedback transistor in response to said second control signal being coupled to the base of said shut-down transistor.

10. The current generator circuit of claim 9, further comprising:

a transistor coupled between said node and the collector of said first current mirror transistor to level-shift the voltage at said node to a voltage greater than the voltage at the collector of said first current mirror transistor, such that said current supply circuit stops supplying current when said second control signal reaches a predetermined voltage of about one $V_{BE}$.

11. In a current generator circuit of the type having a first current supply circuit coupled to a source of voltage for supplying a plurality of currents when said first current supply circuit is biased, a method for placing the current generator circuit in a substantially zero-current shutdown state, the method comprising:

in response to a first control signal, providing a first biasing signal to said first current supply circuit such that said first current supply circuit supplies initial currents;

in response to at least one of said initial currents, supplying a second biasing signal to said first current supply circuit such that said first current supply circuit supplies substantially constant currents; and in response to a second control signal, interrupting the biasing of said first current supply circuit to place the current generator circuit in a zero-current shutdown state in which said first current supply circuit ceases supplying said constant currents and the current generator circuit draws a quiescent current substantially equal to leakage currents.

12. The method of claim 11 wherein said first control signal and said second control signal are coupled to a common node, said providing including applying said first control signal to said common node.

13. The method defined in claim 12 wherein said applying is characterized by use of said first control signal with a value greater than about one $V_{BE}$.

14. The method of claim 11 wherein said first control signal and said second control signal are coupled to a common node, said interrupting including applying said second control signal to said common node.

15. The method defined in claim 14 wherein said applying is characterized by use of said second control signal with a value less than about one $V_{BE}$.

16. The method of claim 11 wherein said first control signal is coupled to a first input terminal and said second control signal is coupled to a second input terminal that is not associated with the first input terminal, said providing including applying said first control signal to said first input terminal.

17. The method of claim 11 wherein said first control signal is coupled to a first input terminal and said second control signal is coupled to a second input terminal that is not associated with the first input terminal, said interrupting including applying said second control signal to said second input terminal.

18. The method of claim 11 wherein the first current supply circuit includes a plurality of parallel-connected transistors and a shutdown circuit coupled between at least one of said plurality of parallel-connected transistors and a bias circuit, said interrupting further comprising stopping current flow from said at least one transistor to said bias circuit when said second control signal is applied.

19. The method of claim 11 wherein a bias circuit is coupled to said first current supply circuit and a shutdown circuit is coupled between said bias circuit and a ground, said interruption further comprising ceasing current flow from said bias circuit to ground when said second control signal is applied.

20. The method of claim 11 wherein the current generator circuit further includes a second current supply circuit that is capable of providing a sink current, said supplying step further including providing a third biasing signal to said second current supply circuit so that said current supply circuit supplies a substantially constant sink current.

21. The method of claim 20 wherein said interrupting further includes interrupting said third biasing signal such that said second current supply circuit substantially stops supplying said constant sink current.

22. A current generator circuit adapted to be coupled to an input voltage source, said current generator circuit comprising:

a start-up circuit that provides a start-up signal in response to a first control signal;

a first current supply circuit coupled for supplying one or more currents in response to said start-up signal;

a bias circuit, coupled to said first current supply circuit that biases said first current supply circuit so that said currents, when provided, are maintained substantially constant, and wherein said biasing circuit is configured to operate independently of said start-up circuit when said first current supply circuit provides said currents; and a shutdown circuit responsive to a second control signal for placing said current generator circuit in a substantially zero-current shutdown state in which said first current supply circuit stops supplying said currents and the current generator circuit draws a quiescent current substantially equal to leakage currents in said first current supply circuit.

23. The current generator circuit of claim 22, wherein said start-up circuit and said shutdown circuit are coupled to a common control terminal, and said first and second control signals are applied to said common control terminal.

24. The current generator circuit of claim 22, further including:

a first control terminal coupled to said start-up circuit; and a second control terminal coupled to said shutdown circuit, said second control terminal being independent of said first control terminal; wherein said first control signal is applied to said first control terminal, and said second control signal is applied to said second control terminal.

25. The current generator circuit of claim 22, wherein said first current supply circuit supplies source currents.

26. The current generator circuit of claim 25, further comprising a second current supply circuit coupled to said bias circuit, said second current supply circuit supplying a substantially constant sink current.

27. The current generator circuit of claim 22, wherein:

said start-up circuit is coupled to draw current from said input voltage source to turn on said first current supply circuit when said first control signal reaches a first predetermined threshold value; and said shutdown circuit is coupled to remove bias current from said bias circuit to turn off said current supply circuit when said second control signal reaches a second predetermined threshold value.

28. The current generator of claim 27, further comprising a control terminal coupled in common to said start-up circuit and to said shutdown circuit, wherein said first and second control signals are applied to said common control terminal.

29. The current generator of claim 22, wherein said current generator circuit is configured to operate independently of current from said start-up circuit when said first current supply circuit provides said currents.

* * * * *